US011118603B2

(12) United States Patent
Xu et al.

(10) Patent No.: US 11,118,603 B2
(45) Date of Patent: Sep. 14, 2021

(54) FAN DEVICE

(71) Applicant: VAST GLORY ELECTRONICS & HARDWARE & PLASTIC(HUI ZHOU) LTD., Hui Zhou (CN)

(72) Inventors: Shi Man Xu, Hui Zhou (CN); Qiancheng Yue, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 0 days.

(21) Appl. No.: 16/904,159

(22) Filed: Jun. 17, 2020

(65) Prior Publication Data

US 2021/0199128 A1 Jul. 1, 2021

(30) Foreign Application Priority Data

Dec. 31, 2019 (CN) ..... 201911414629.X

(51) Int. Cl.

| | |
|---|---|
| ***F04D 29/60*** | (2006.01) |
| ***F04D 19/00*** | (2006.01) |
| ***F21V 33/00*** | (2006.01) |
| ***F04D 29/40*** | (2006.01) |
| *F21Y 103/33* | (2016.01) |

(52) U.S. Cl.

CPC ..... *F04D 29/601* (2013.01); *F04D 19/002* (2013.01); *F04D 29/403* (2013.01); *F21V 33/0096* (2013.01); *F21Y 2103/33* (2016.08)

(58) Field of Classification Search

CPC .... F04D 29/601; F04D 29/403; F04D 19/002; F21V 33/0096

See application file for complete search history.

(56) References Cited

U.S. PATENT DOCUMENTS

| | | | | |
|---|---|---|---|---|
| 7,537,429 | B2 * | 5/2009 | Xia | F16B 19/004 415/119 |
| 8,043,049 | B2 * | 10/2011 | Chen | F04D 25/0613 415/119 |
| 2007/0237625 | A1 * | 10/2007 | Liang | F04D 29/668 415/119 |
| 2009/0162195 | A1 * | 6/2009 | Nelson | F04D 29/646 415/219.1 |
| 2015/0023779 | A1 * | 1/2015 | Li | F04D 19/002 415/119 |

* cited by examiner

*Primary Examiner* — Evan P Dzierzynski

(74) *Attorney, Agent, or Firm* — Maschoff Brennan

(57) ABSTRACT

A fan device includes a fan frame, an impeller, a plurality of cushion components, a plurality of first fasteners and a plurality of second fasteners. The fan frame includes a first frame body and a second frame body. The first frame body has a plurality of first engagement parts. The second frame body has a plurality of second engagement parts. The impeller is rotatably disposed on the fan frame. The cushion components are respectively located on different sides of the fan frame. The first fasteners are respectively disposed through the cushion components and engaged with the first engagement parts of the first frame body. The second fasteners are respectively disposed through the cushion components and engaged with the second engagement parts of the second frame body.

9 Claims, 4 Drawing Sheets

FAN DEVICE

CROSS-REFERENCE TO RELATED APPLICATIONS

This non-provisional application claims priority under 35 U.S.C. § 119(a) on Patent Application No(s). 201911414629.X filed in China on Dec. 31, 2019, the entire contents of which are hereby incorporated by reference.

BACKGROUND

Technical Field

This disclosure relates to a fan device, more particularly to a fan device having interlocking frame components.

Related Art

Nowadays, it is an era of information explosion, and electronic products have become inseparable from daily life. With the development of technology, electronic products have been innovated as well. With respect to the development and application of personal computers, desktop personal computers were developed first. However, desktop personal computers are large in size, so they are not easy to carry. Therefore, portable notebook personal computers and tablet personal computers are developed. With the trend towards light-and-thin portable electronic devices and the improvement of performance thereof, the amount of heat generated by the portable electronic devices is increasing. Thus, it is necessary to effectively dissipate heat from heat sources to the outside by heat dissipation devices so as to ensure the portable electronic devices can function normally. Fans are one of the most commonly used heat dissipation devices, which draw or blow hot air near the heat sources away so the heat generated by the heat sources can be brought away by the air nearby, thus dissipating heat.

In some cases, fan is required to be able to emit light and absorb vibration, such that its fan frame should consist of several interlocking components to enable the installations of light-emitting device and cushion pad onto the fan frame. However, assembling the conventional fan frames with interlocking components is troublesome and complex in process. Accordingly, it is been a topic for simplifying the assembly process of the fan frame.

SUMMARY

The present disclosure provides a fan device that facilitates the installation of its frame components.

One embodiment of the disclosure provides a fan device including a fan frame, an impeller, a plurality of cushion components, a plurality of first fasteners and a plurality of second fasteners. The fan frame includes a first frame body and a second frame body. The first frame body has a plurality of first engagement parts. The second frame body has a plurality of second engagement parts. The impeller is rotatably disposed on the fan frame. The cushion components are respectively located on different sides of the. The first fasteners are respectively disposed through the cushion components and engaged with the first engagement parts of the first frame body. The second fasteners are respectively disposed through the cushion components and engaged with the second engagement parts of the second frame body.

One embodiment of the disclosure provides a fan device including a fan frame, an impeller and a plurality of cushion components. The fan frame includes a first frame body and a second frame body. The first frame body has a plurality of first engagement parts. The second frame body has a plurality of second engagement parts. The impeller is rotatably disposed on the fan frame. The cushion components are respectively located on different sides of the fan frame, and each of the cushion components is engaged with one of the first engagement parts of the first frame body and one of the second engagement parts of the second frame body.

According to the fan device as described above, the first frame body and the second frame body each have one or more engagement parts for the engagement with the cushion components so that simply installing the cushion components can complete the assembly of the first frame body and the second frame body and the assembly of the cushion components and the fan frame, while the first and second frame bodies may not have additional fixing features for them to be fixed to each other.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
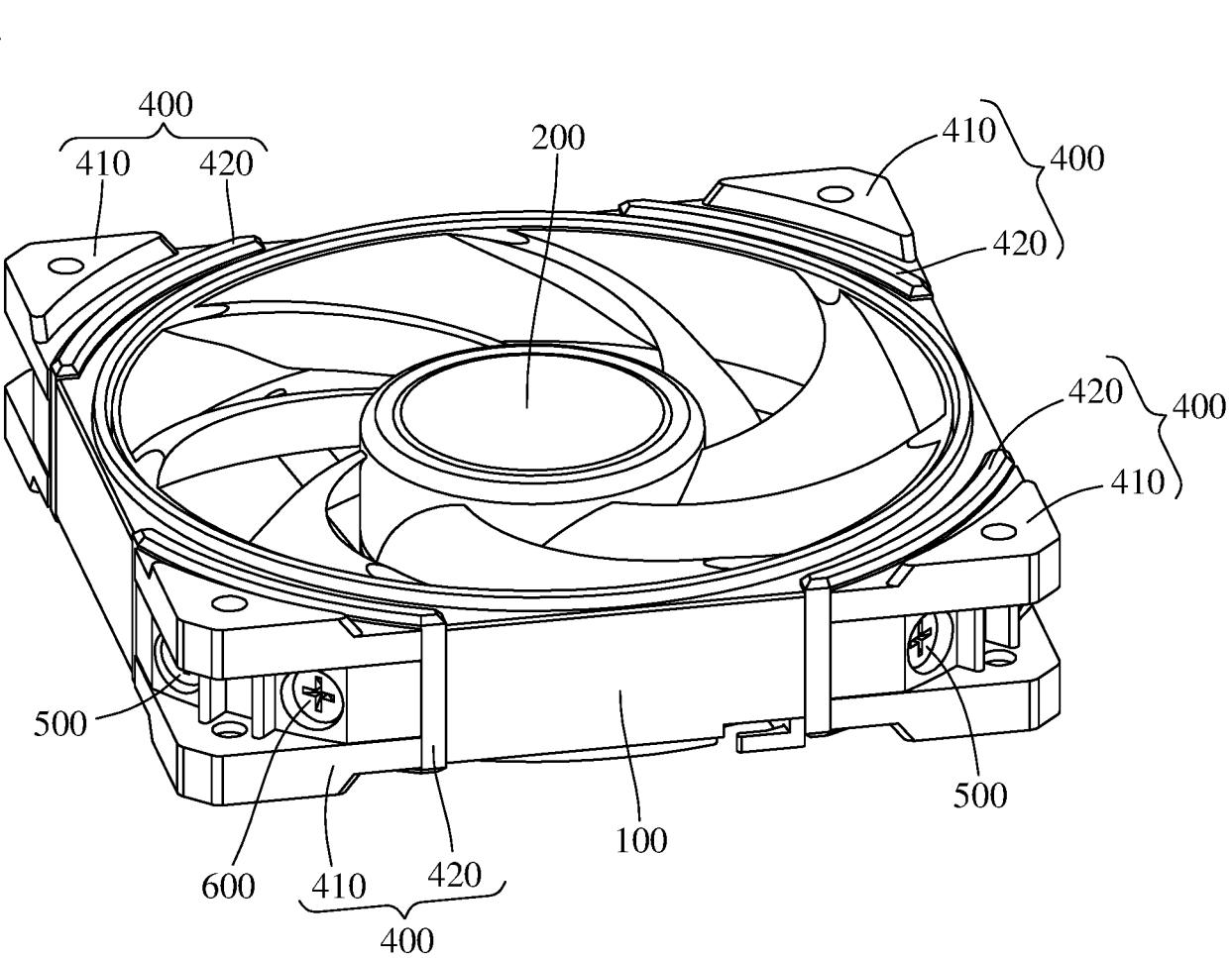
FIG. 1 is a perspective view of a fan device in accordance with a first embodiment of the disclosure.
Figure 2:
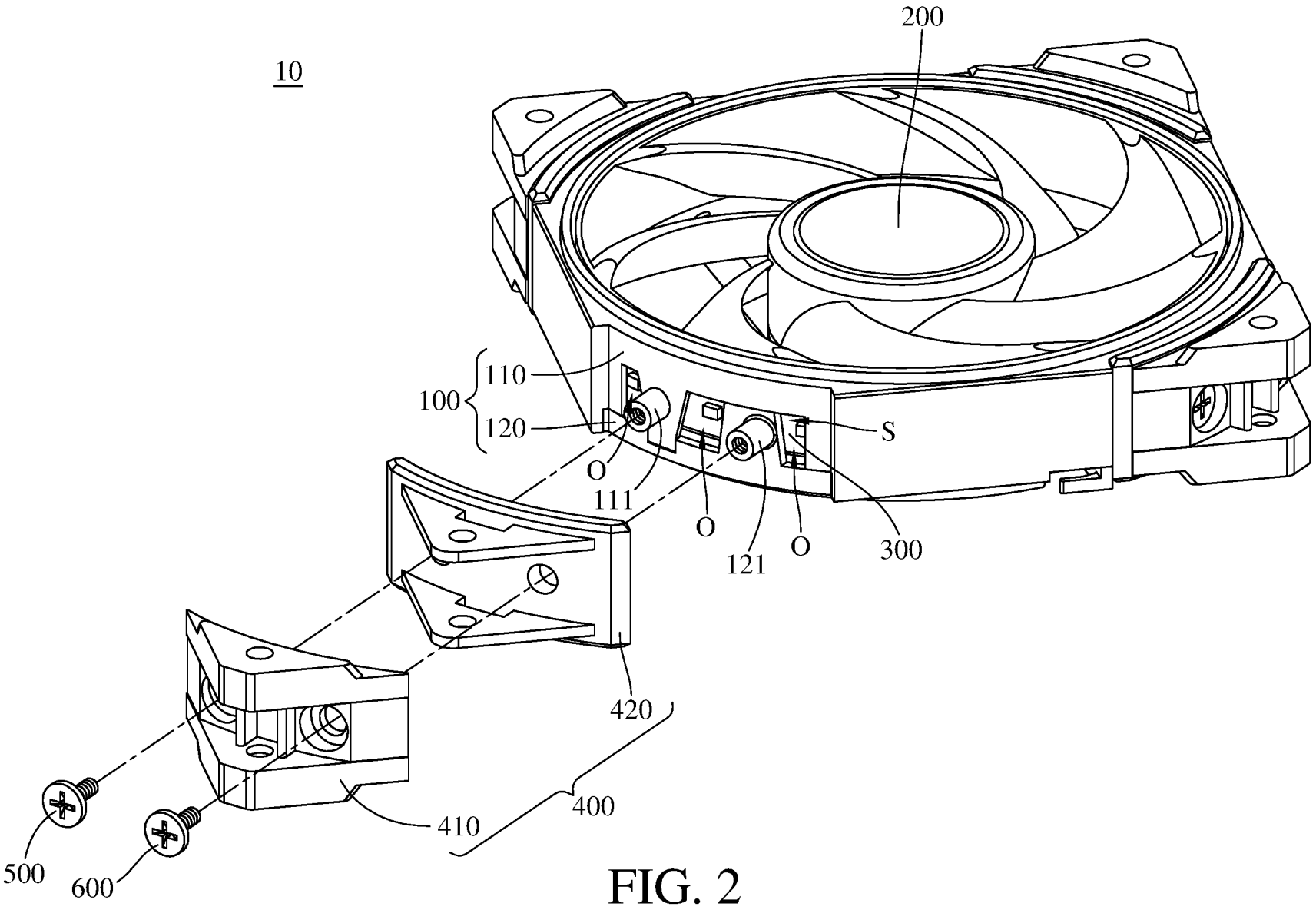
FIG. 2 is a partial exploded view of the fan device in FIG. 1.
Figure 3:
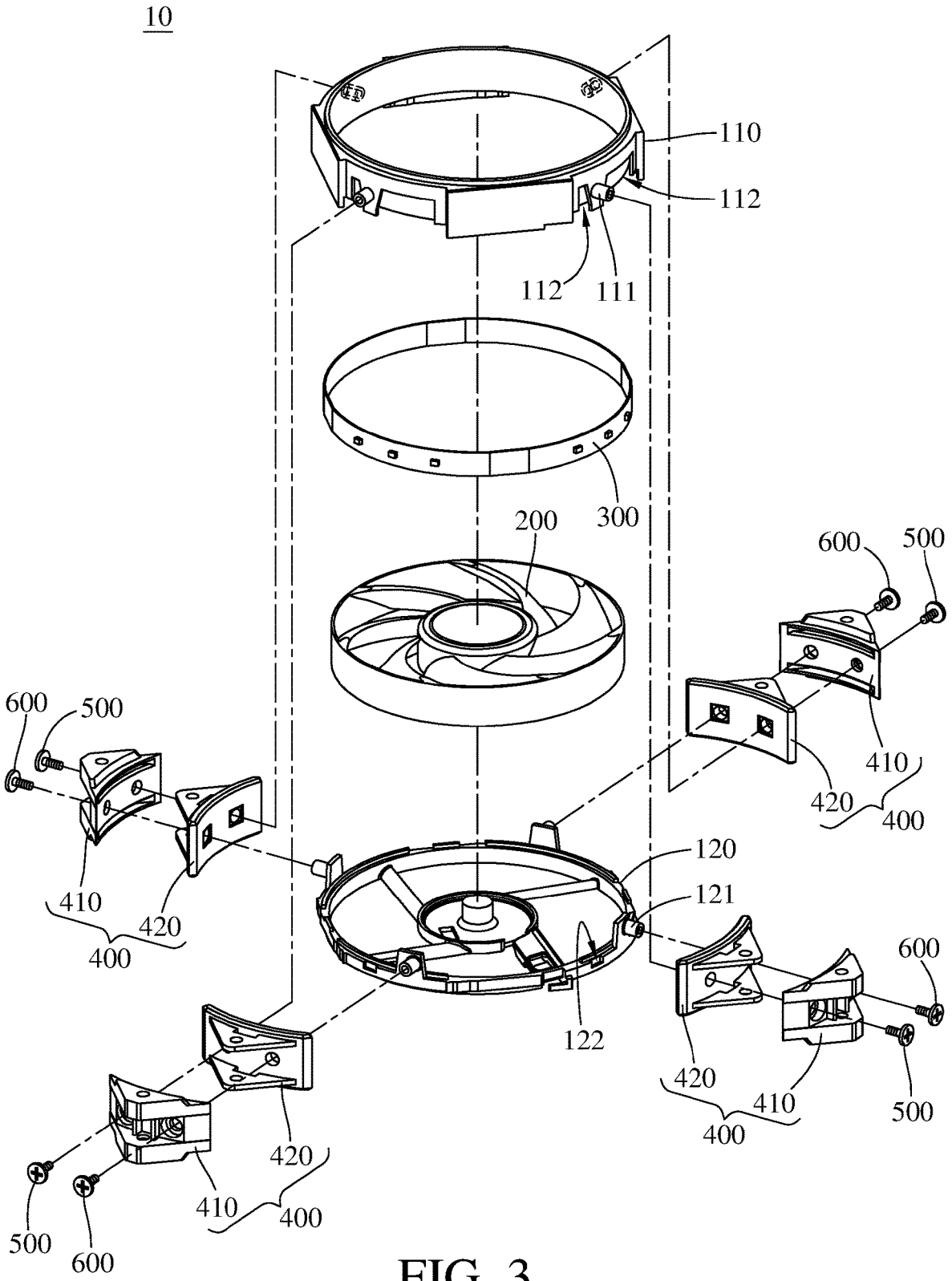
FIG. 3 is an exploded view of the fan device in FIG. 1.

Please refer to FIG. 1 to FIG. 3. FIG. 1 is a perspective view of a fan device in accordance with a first embodiment of the disclosure, FIG. 2 is a partial exploded view of the fan device in FIG. 1, and FIG. 3 is an exploded view of the fan device in FIG. 1.

In this embodiment, a fan device 10 is provided. The fan device 10 includes a fan frame 100, an impeller 200, a light source 300, four cushion components 400, four first fasteners 500 and four second fasteners 600.

The fan frame 100 includes a first frame body 110 and a second frame body 120. The first frame body 110 has a plurality of first engagement parts 111, and the second frame body 120 has a plurality of second engagement parts 121. Each of the first engagement parts 111 and the second engagement parts 121 is, for example, a screw post with a screw hole. In addition, the first frame body 110 and the second frame body 120 together form a storage space S therebetween. The first frame body 110 has a plurality of openings 112, and the second frame body 120 has a plurality of openings 122. The openings 112 of the first frame body 110 and the openings 122 of the second frame body 120 together form a plurality of through holes O connected to the storage space S.

The impeller 200 is rotatably disposed on the fan frame 100. During the operation of the fan device 10, the rotation of the impeller 200 can generate airflow for removing heat generated by a heat source.

The light source 300 is in a form of, for example, ring shape having one or more light-emitting devices thereon. The light source 300 is disposed in the storage space S. Light emitted from the light source 300 can propagate through the through holes O to the outside.

The cushion components 400 are respectively located on different sides of the fan frame 100. Each of the cushion components 400 includes a flexible part 410 and a light-permeable part 420. The flexible parts 410 are made of, for example, rubber. And each flexible part 410 is fixed to the respective light-permeable part 420 via, for example, adhesive. The light-permeable parts 420 are made of, for example, light-permeable plastic. And each light-permeable part 420 is disposed between and clamped by the respective flexible part 410 and the fan frame 100. The light-permeable parts 420 respectively cover the through holes O, and each of the light-permeable parts 420 has a part not covered by the flexible parts 410 and therefore exposed to the outside. In such an arrangement, the light-permeable parts 420 can guide the light coming from the through holes O to the outside.

In this embodiment, the flexible parts 410 are opaque, but the present disclosure is not limited thereto. In other embodiments, the flexible parts may be light-permeable as well.

The first fasteners 500 and the second fasteners 600 are, for example, screws. The first fasteners 500 are disposed through the flexible parts 410 and the light-permeable parts 420 of the cushion components 400 and respectively engaged with the first engagement parts 111 of the first frame body 110. The second fasteners 600 are disposed through the flexible parts 410 and the light-permeable parts 420 of the cushion components 400 and respectively engaged with the second engagement parts 121 of the second frame body 120. As such, the first frame body 110 and the second frame body 120 can be assembled together as the cushion components 400 are fixed to them via the first and second fasteners 500 and 600. That is, installing first and second fasteners 500 and 600 can fix the cushion components 400 and assemble the first frame body 110 and the second frame body 120 of the fan frame 100 at the same time. In such an arrangement, there may be no additional fixing features on the first frame body 110 and the second frame body 120, and the assembly of the first frame body 110, the second frame body 120 and the cushion components 400 can be completed by simply installing the first and second fasteners 500 and 600; in other words, the assembly of the first frame body 110 and the second frame body 120 and the assembly of the cushion components 400 and the fan frame 100 can be completed by installing the cushion components 400.

Note that the first fasteners 500 and the second fasteners 600 are not restricted to be screws; in other embodiments, first fasteners and second fasteners may be snaps or rivets.

Note that the light source 300 may be optional; in other embodiments, the fan device may not have any light source.

Figure 4:
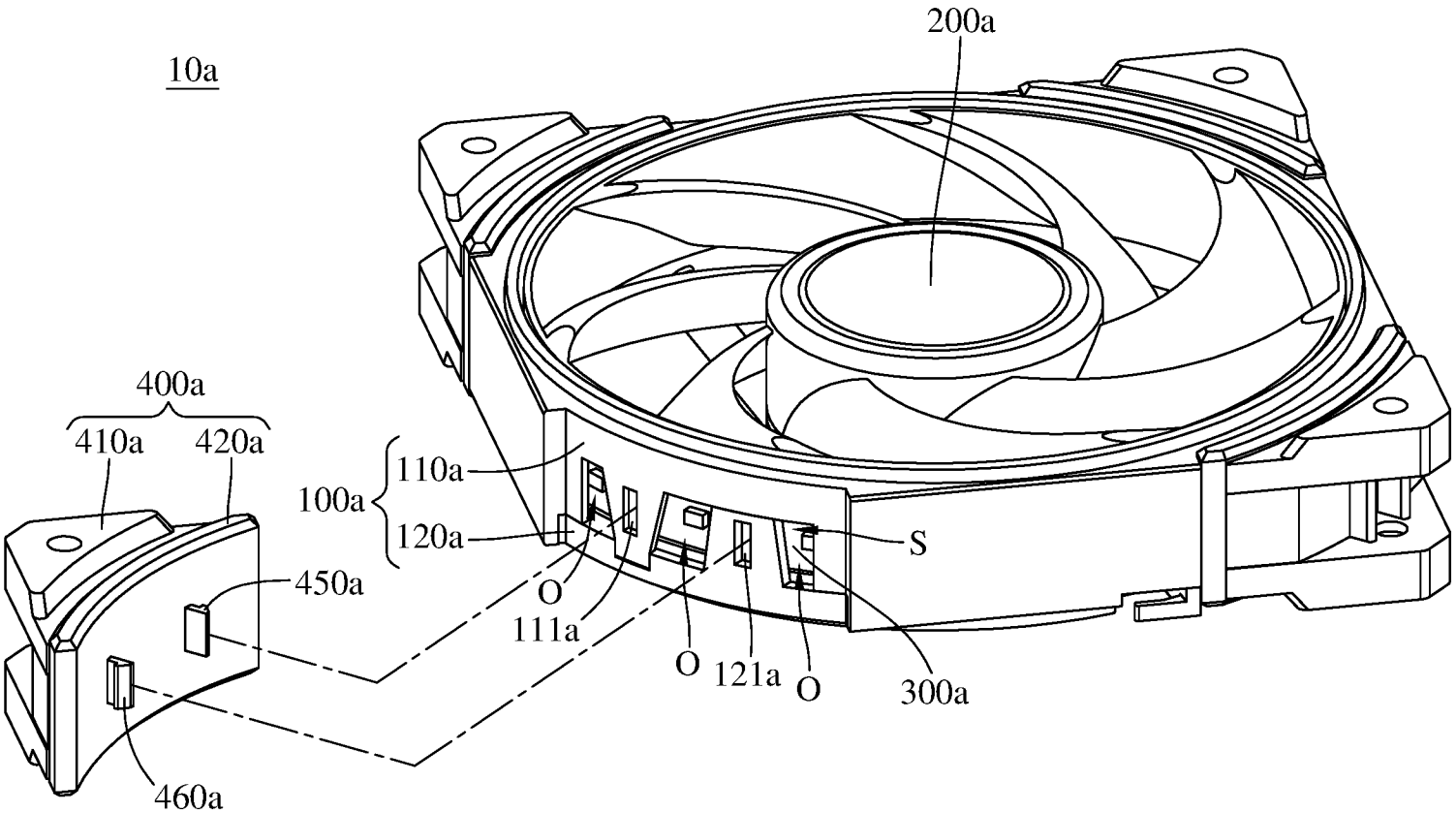
FIG. 4 is a partial exploded view of a fan device in accordance with a second embodiment of the disclosure.

In addition, in the disclosure, the installation of the cushion components onto the fan frame is not restricted to be achieved by fasteners. For example, referring to FIG. 4, a partial exploded view of a fan device in accordance with a second embodiment of the disclosure is provided.

As shown, a fan device 10*a* is provided. The fan device 10*a* includes a fan frame 100*a*, an impeller 200*a*, a light source 300*a* and four cushion components 400.

The fan frame 100*a* includes a first frame body 110*a* and a second frame body 120*a*. The first frame body 110*a* has a plurality of first engagement parts 111*a*, and the second frame body 120*a* has a plurality of second engagement parts 121*a*. Each of the first engagement parts 111*a* and the second engagement parts 121*a* is, for example, a groove. In addition, the first frame body 110*a* and the second frame body 120*a* together form a storage space S therebetween and a plurality of through holes O connected to the storage space S.

The impeller 200*a* is rotatably disposed on the fan frame 100*a*. During the operation of the fan device 10*a*, the rotation of the impeller 200*a* can generate airflow for removing heat generated by a heat source.

The light source 300*a* is in a form of, for example, ring shape having one or more light-emitting devices thereon. The light source 300*a* is disposed in the storage space S. Light emitted from the light source 300*a* can propagate through the through holes O to the outside.

The cushion components 400*a* are respectively located on different sides of the fan frame 100*a*. Each of the cushion components 400*a* is engaged with both one of the first engagement parts 111*a* of the first frame body 110*a* and one of the second engagement parts 121*a* of the second frame body 120*a*. Specifically, each of the cushion components 400*a* includes a first engaging part 450*a* and a second engaging part 460*a*. The first engaging parts 450*a* of the cushion components 400*a* are respectively engaged with the first engagement parts 111*a* of the first frame body 110*a*, and the second engaging parts 460*a* of the cushion components 400*a* are respectively engaged with the second engagement parts 121*a* of the second frame body 120*a*. As such, the assembly of the first frame body 110*a* and the second frame body 120*a* and the assembly of the cushion components 400*a* and the fan frame 100*a* can be completed by installing the cushion components 400*a*.

Furthermore, each of the cushion components 400*a* includes a flexible part 410*a* and a light-permeable part 420*a*. The flexible parts 410*a* are made of, for example, rubber. And each flexible part 410*a* is fixed to the respective light-permeable part 420*a* via, for example, adhesive. The light-permeable parts 420*a* are made of, for example, light-permeable plastic. And each light-permeable part 420*a* is disposed between and clamped by the respective flexible part 410*a* and the fan frame 100*a*. The light-permeable parts 420*a* respectively cover the through holes O, and each of the light-permeable parts 420*a* has a part not covered by the flexible parts 410*a* and therefore exposed to the outside. In such an arrangement, the light-permeable parts 420*a* can guide the light coming from the through holes O to the outside.

In this embodiment, the flexible parts 410*a* are opaque, but the present disclosure is not limited thereto. In other embodiments, flexible parts may be light-permeable as well.

Note that the light source 300*a* may be optional; in other embodiments, the fan device may not have any light source.

According to the fan device as described above, the first frame body and the second frame body each have one or more engagement parts for the engagement with the cushion components so that simply installing the cushion components can complete the assembly of the first frame body and the second frame body and the assembly of the cushion components and the fan frame, while the first and second frame bodies may not have additional fixing features for them to be fixed to each other.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. A fan device, comprising:

a fan frame, comprising a first frame body and a second frame body, the first frame body having a plurality of first engagement parts, and the second frame body having a plurality of second engagement parts;

an impeller, rotatably disposed on the fan frame;

a plurality of cushion components, respectively located on different sides of the fan frame;

a plurality of first fasteners, respectively disposed through the plurality of cushion components and engaged with the plurality of first engagement parts of the first frame body; and a plurality of second fasteners, respectively disposed through the plurality of cushion components and engaged with the plurality of second engagement parts of the second frame body.

2. The fan device according to claim 1, further comprising a light source, wherein the first frame body and the second frame body together form a storage space and at least one through hole therebetween, the light source is disposed in the storage space, and light emitted from the light source propagates through the at least one through hole.

3. The fan device according to claim 2, wherein the quantity of the at least one through hole is plural, each of the plurality of cushion components comprises a flexible part and a light-permeable part, the light-permeable part is disposed between and clamped by the flexible part and the fan frame, and the light-permeable parts respectively cover the through holes.

4. The fan device according to claim 3, wherein each of the plurality of first fasteners and each of the plurality of the second fasteners are disposed through the flexible part and the light-permeable part of one of the plurality of cushion components.

5. The fan device according to claim 3, wherein the plurality of first fasteners and the plurality of second fasteners are screws, snaps or rivets.

6. A fan device, comprising:

a fan frame, comprising a first frame body and a second frame body, the first frame body having a plurality of first engagement parts, and the second frame body having a plurality of second engagement parts;

an impeller, rotatably disposed on the fan frame; and a plurality of cushion components, respectively located on different sides of the fan frame, and each of the plurality of cushion components being engaged with one of the plurality of first engagement parts of the first frame body and one of the plurality of second engagement parts of the second frame body.

7. The fan device according to claim 6, wherein each of the plurality of cushion components comprises a first engaging part and a second engaging part, the first engaging parts of the plurality of cushion components are respectively engaged with the plurality of first engagement parts of the first frame body, and the second engaging parts of the plurality of cushion components are respectively engaged with the plurality of second engagement parts of the second frame body.

8. The fan device according to claim 6, further comprising a light source, wherein the first frame body and the second frame body together form a storage space and at least one through hole therebetween, the light source is disposed in the storage space, and light emitted from the light source propagates through the at least one through hole.

9. The fan device according to claim 8, wherein the quantity of the at least one through hole is plural, each of the plurality of cushion components comprises a flexible part and a light-permeable part, the light-permeable part is disposed between and clamped by the flexible part and the fan frame, and the light-permeable parts respectively cover the through holes.

* * * * *